US005166278A

United States Patent [19]

Rao

[11] Patent Number: 5,166,278

[45] Date of Patent: Nov. 24, 1992

[54] PROCESS FOR MODIFYING POLYAMIDE DYEABILITY USING CO-FED POLYAMIDE FLAKE

[75] Inventor: Sundar M. Rao, Seaford, Del.

[73] Assignee: E. I. Du Pont de Nemours and Company, Wilmington, Del.

[21] Appl. No.: 511,178

[22] Filed: Apr. 17, 1990

[51] Int. Cl.[5] ..... C08L 77/00; B29C 47/00

[52] U.S. Cl. ..... 525/432; 264/211.22; 264/331.19

[58] Field of Search ..... 525/432; 264/331.19, 264/211.22

[56] References Cited

U.S. PATENT DOCUMENTS 3,357,955 12/1967 Bryan ..... 260/78
3,796,692 3/1974 Foltz et al. ..... 260/78 R
3,884,582 5/1975 Britt et al. ..... 356/173
3,985,714 10/1976 Kidder ..... 260/78 R
4,104,324 8/1978 Radlmann et al. ..... 325/432
4,937,034 4/1989 Sewell ..... 264/349

FOREIGN PATENT DOCUMENTS 56-015404 2/1981 Japan .
61-089316 5/1986 Japan .

*Primary Examiner*—Ana L. Carrillo

[57] ABSTRACT

A process for modifying the dyeability of polyamide polymers is disclosed, the process involving the addition of co-fed polyamide flake of the same type of polyamide as the base polyamide with the co-fed flake having a significant effect on the final dyeability. The additive flake comprises high- or low-amine-end polyamide flake which is mixed and melted with the base polyamide to adjust the total number of amine ends in the polymer, thereby controlling the polymer dyeability.

4 Claims, 1 Drawing Sheet

PROCESS FOR MODIFYING POLYAMIDE DYEABILITY USING CO-FED POLYAMIDE FLAKE

TECHNICAL FIELD

This invention relates to a process for modifying the dyeability of polyamide polymers by addition of co-fed polyamide flake of the same type of polyamide as the base polyamide, the co-fed flake having a significant effect on the final dyeability. More specifically, the additive flake comprises high- or low-amine-end polyamide flake which is mixed and melted with the base polyamide to adjust the total number of amine ends in the polymer, thereby controlling the polymer dyeability. In one embodiment of the current invention, the process steps comprise introducing the additive polyamide pellets into a stream of base polyamide pellets at the inlet to a twin-screw melter extruder in a suitable ratio to control the polyamide dyeability within specified limits, mixing and melting in the screw melter, and extruding the modified polyamide into fibers.

BACKGROUND OF THE INVENTION

The concentration of amine ends (usually expressed as meq/kg polymer) in polyamide polymers affects the affinity of shaped articles made of these polymers for certain dyestuffs. The amine-end concentration determines the dye capacity of polyamide materials and variations in amine-end concentration will cause nonuniformities in the depth of shade after dyeing. Light-dye polyamide yarn has about 10±5 meq/kg amine ends, normal mid-dye polymer about 40±5 meq/kg amine ends, and deep-dye polymer about 70±5 meq/kg amine ends. The dyeability of a polyamide may be measured in dye units, as described in the ABB dye test given below. A value of 180 units is used to adjust and normalize sample dyeability to a known base. Control is typically 180±13 dye units for bulk continuous filament polyamide fiber and future trade requirements will demand control within about ±6 dye units. A change in amine-end concentration of 1 meq/kg will result in a change in fiber dyeability of about 12 dye units. Hence, in order to control dyeability to within ±6 dye units, amine-end groups must be controlled to within ±0.5 meq/kg.

In a conventional batch polymerization process for the production of polyamide polymers, a polyamide precursor salt is concentrated in a batch evaporator, the concentrated salt polymerized in a batch autoclave, extruded into a solid ribbon, and chipped into pellets or granules commonly referred to as polymer flake. The polymer flake is melted in an extruder and extruded into various shapes depending on the desired end use. If the properties of the extruded material are not within specifications, the composition of the next batch of polymer can be appropriately adjusted. For example, in the case of polyamide fiber dyeability, the amount of diamine or diacid can be adjusted in the autoclave during the preparation of the base polymer flake to control the amine-end concentration and bring the dyeability within specified limits. However, during the lag time that occurs between detection of the deviation and adjustment of the composition of the salt solution used to prepare the polymer flake (which can be on the order of 8–24 hours), large quantities of fiber may be produced with out-of-limits dyeability, resulting in either yield loss or increased dye variability. In the case where the polyamide base flake is not manufactured in-house, but rather shipped from a supplier at another location, a new shipment must be ordered if the properties are not within the desired limits which can involve lag times of weeks to months.

U.S. Ser. No. 07/425,388 describes a process whereby batch-produced polyamide dyeability is modified by injecting a diamine into a low pressure region of a screw melter extruder to increase the total amine end-group concentration. This permits quick response to deviations in polyamide dyeability. However, it requires a special injection system to accomplish the diamine addition.

SUMMARY OF THE INVENTION

It has now been found that in a process for melt-spinning polyamide fibers including the steps of feeding a first polyamide flake having a first amine-end level into a screw melter extruder, melting the flake and then extruding the molten polyamide into fibers, an improvement for modifying the dyeability of the fibers may be obtained, the improvement comprising the steps of:

a) co-feeding a second polyamide flake of the same polymer type but having a different amine-end level into the extruder with the first polyamide flake, the quantity and amine-end level of the second flake being such that when mixed with the first flake a mixture having a predetermined dyeability is obtained; and b) mixing and melting the two flakes to form a homogenous molten mixture before extruding the molten mixture into fibers.

In a further embodiment involving a process for melt-spinning polyamide fibers including the steps of pumping a first polyamide through a transfer line to a spinneret, and then extruding the polyamide into fibers, the improvement for modifying the dyeability of the fibers comprises the steps of:

a) co-feeding a polyamide flake of the same polymer type but having a different amine-end level into the transfer line with the first polyamide, the quantity and amine-end level of the polyamide flake being such that when mixed with the first polyamide a mixture having a predetermined dyeability is obtained; and b) melting the polyamide flake and mixing the two polyamides to form a homogenous molten mixture before extruding the molten mixture into fibers.

DETAILED DESCRIPTION

Figure 1:
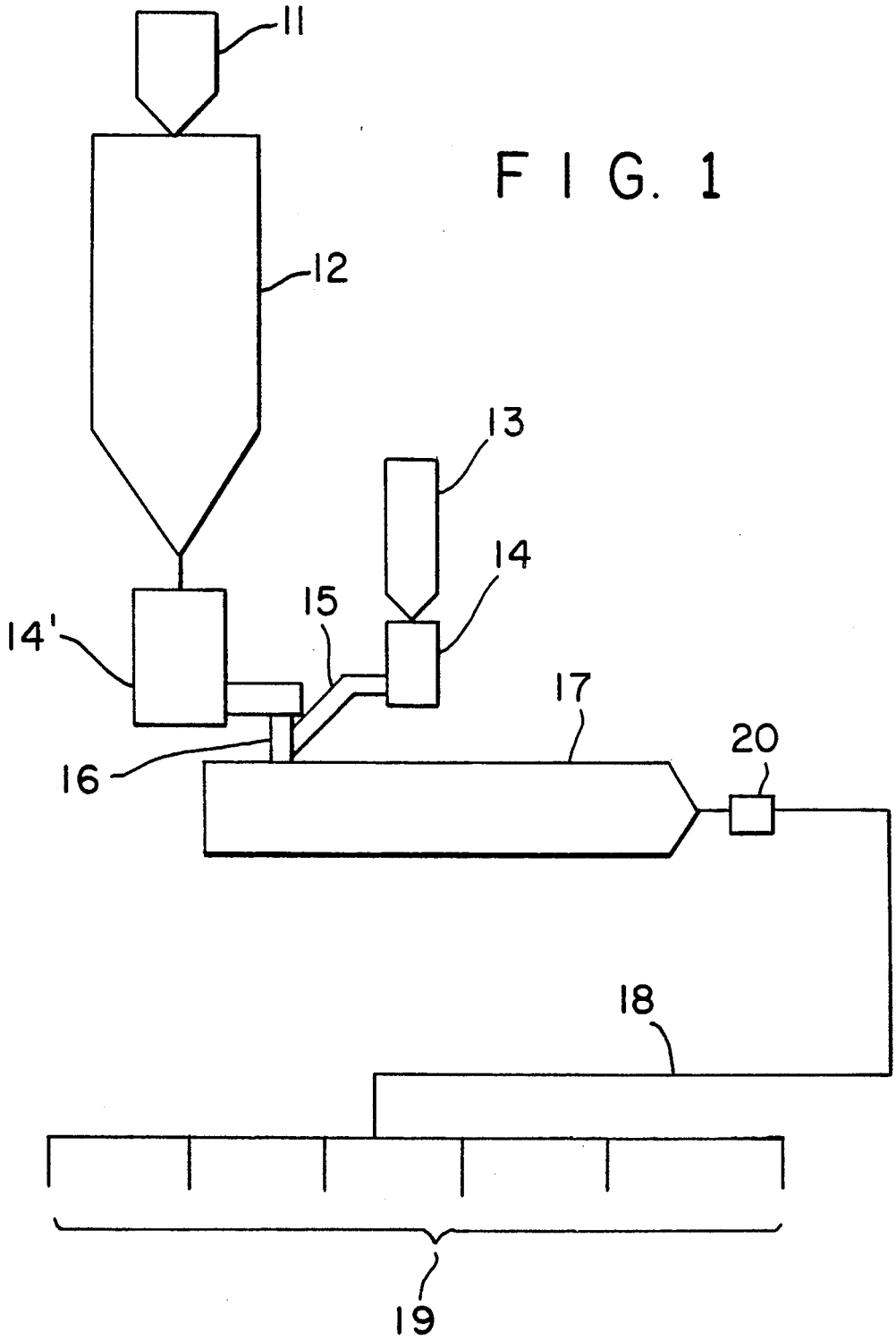
FIG. 1 is a schematic diagram of a preferred embodiment of the process of the current invention.

One embodiment of the current invention provides a method for controlling polyamide dyeability using commercially available equipment which comprises adding high- or low-amine-end polyamide flake to base polyamide flake in an extruder to adjust the total amine end-group concentration to a predefined level to achieve improved dye uniformity, with much shorter lag times than conventional processes. This may be accomplished by using an additive feeder system which feeds additive polyamide pellets into the throat of an extruder at a controlled feed rate, the feed rate being a function of the total polymer throughput and the desired amine-end group concentration in the final polymer. The additive polyamide flake is mixed with base polyamide flake that is supplied from a main feeder, as in a conventional process, to provide a polyamide with modified dyeability. In order to achieve uniform mixing, it is preferable that a twin-screw extruder be used. A single-screw or a rotary type extruder may also be used, however mixing may not be as complete resulting in a reduction in the yarn dye-uniformity. The melt-blended polyamide is then melt-spun to form fibers.

The process of the current invention may also be useful when a large screw melter or continuous polymerization unit is used to feed more than one spinning machine, and it is desired to spin polymers having. different dyeability, e.g., a deep-dye polymer on one spinning machine and a light-dye polymer on the other. In such an example, a light-dye polymer base flake is used (or a comparable polymer is polymerized in the continuous unit) and melted deep-dye additive flake injected into one of the transfer lines. In such processes, it is necessary to use additional mixing means in the transfer line to ensure complete mixing of the additive and base polyamides.

As used herein the term "base polyamide" refers to the flake supplied from the main feeder or the polymer formed in the continuous polymerization unit, the dyeability of which is to be adjusted and controlled by use of the additive flake. The base polyamide may be any polyamide, including, without limitation, nylon 6,6, nylon 6, nylon 6,10, nylon 6,12, and nylon copolymers. The additive flake should generally be of the same polymer type as the base polyamide, differing only in its amine-end concentration, the amine-end concentration being either greater or less than that of the base polymer. The term "same polymer type" it is intended to mean a polymer having the same repeating unit, though not necessarily having the same molecular weight. Thus a nylon 6,6 additive flake should be used to adjust the dyeability of nylon 6,6 base polymer, a nylon 6 flake used to adjust nylon 6 base polymer, etc.

Regardless of the method used for co-feeding additive and base polymers, it is necessary to allow sufficient lag time during transport to the spinnerets for the molecular chain length and end-group concentrations of the molten polymer mixture to change and approach their equilibrium values via transamidation reactions. Calculations and tests show that in a conventional melt-spinning process, the residence time of the polymer in the piping before it is spun into fiber is sufficient for end-group stabilization to occur. A mixture of polyamides of different molecular weights will yield a polymer of normal molecular weight distribution due to the amide-exchange reaction.

In FIG. 1, a supply hopper 11 supplies base polyamide pellets of known amine-end concentration at a controlled temperature to a conditioner 12 where moisture is removed from the pellets to the extent required to achieve the desired molecular weight of the final product. An additive hopper 13 is filled with the additive polyamide flake of pre-determined amine-end group concentration and fed with a feeder 14, capable of accurately feeding flake at a controlled pre-determined feed rate calculated to achieve the desired concentration of amine ends in the final polymer, into a piping 15 connected to the throat 16 of a twin-screw extruder 17. The base polyamide flake is also fed into 16 via a separate feeder 144', where it mixes with the additive flake and enters the twin-screw extruder 17. Melting of the two polymer streams occurs and the molecular chains of the polyamides undergo a transamidation reaction in the screw extruder and in the piping of the transfer line 18 leading to the spinnerets 19. A booster pump 20 is used to pump the polymer through the transfer line 18. As the polymer mixture is transported to the spinnerets, the molecular weight and amine-end group concentration approach their equilibrium values so that the final polymer is indistinguishable from one in which the amine-end concentration is corrected during autoclave polymerization. The process of the current invention allows the correction to be made in a more timely manner. The polymer is then extruded into filaments at the spinnerets. The ABB dyeability or amine-end concentration of the fibers is monitored, and if the values deviate from the on-aim limits, the rate of addition of the additive polymer flake is adjusted to bring the values within predefined specifications. The change in the feeder rate may be calculated according to the equation:

$$R_N/R_T=[1/(C_A-C_B)]\{(NH_{2aim}/NH_{2meas})[(R_O/R_T)(C_A-C_B)+C_B]-C_B\}$$

where $R_N$=new rate of addition (lb/hr), $R_O$=old rate of addition (lb/hr), $R_T$=total throughput (lb/hr), $C_A$=additive amine-end concentration (ends/$10^6$ g of polymer), $C_B$=base-flake amine-end concentration (ends/$10^6$ g of polymer), $NH_{2aim}$ is the aim amine end level, and $NH2_{meas}$ is the measured $NH_2$ level. (Alternatively, ABB measurements may be substituted for aim and measured amine end levels, using the conversion factor of $1NH_2$ end being approximately equivalent to 13 ABB dye units.) If the desired change is not achieved upon adjustment of feed rate, other process parameters may be responsible for the measured deviations and should be investigated.

The same equation may be used to determine the initial rate of addition for the additive polymer by setting $R_O=0$ and calculating $R_N$ as a function of $R_T$.

TEST PROCEDURES AND EXAMPLE

In the procedures and example set forth below, all percentages are by weight unless otherwise indicated. Amine-end levels were determined by potentiometric titration using an 80:20 phenol/methanol solvent and perchloric acid as the titrant.

YARN DYEING PROCEDURES

Polyamide dyeability was measured using two types of dye tests, referred to herein as the MBB and ABB dye tests. The MBB dye test uses a high molecular weight dye (Anthraquinone Milling Blue B) so that the rate of dye uptake is sensitive to structural changes, such as degree of orientation and crystallinity, induced in the fiber due to variations in process parameters. The ABB dye test is run using a less structurally sensitive dye (Anthraquinone Blue B) at a higher temperature and for a longer time than the MBB dye test so that the dyeing process approaches equilibrium and the dyeability measured is dependent on the amine-end group concentration. The MBB measurement is not significantly affected by changes in ABB dyeability. For example, experience has shown that an ABB dye change of 15–20 dye units will result in a MBB dye change of approximately 5 dye units.

The MBB dye test is performed by placing 16 pads of yarn, 4 grams each in a scouring solution prepared from 90 ml 18% sodium hydroxide solution and 100 ml of 10% Merpol HCS (a liquid, nonionic detergent, E. I. du Pont de Nemours & Co.). The temperature of the bath is increased at a rate of 3° C./min to 40 ° C. and held at temperature for 15 minutes. The bath is drained and filled with a dye solution prepared from 200 ml of an MBB buffer solution having a pH of 5.28–5.32 and 500 ml of 0.18% Anthraquinone Milling Blue BL (C.I. Acid Blue 122) dye solution. The MBB buffer solution is prepared by first mixing 49000 gm monosodium phosphate (FMC Corp., Philadelphia, Pa.) and 620 gm of a 50% sodium hydroxide solution in 88 liters of water, taking 8 gms of this combined solution, and diluting with 992 gms of water. The dye bath temperature is increased at 3° C./min to 60° C. and held at temperature for 10 min. The dyed samples are rinsed, dried, and measured for dye depth using a reflecting colorimeter.

The ABB dye test involves scouring 16 pads of yarn, 2.5 gm each in a solution containing 200 ml of a 10% solution of Merpol HCS (a liquid, nonionic detergent, from E. I. du Pont de Nemours & Co.), 5 ml of Depuma (a silicone defoaming agent), and 100 ml of an ABB buffer solution. This ABB buffer solution is prepared by first mixing 49,000 gms of monosodium phosphate (FMC Corp., Philadelphia, Pa.) and 2,500 gms of a 50% sodium hydroxide solution in 88 liters of water, taking 4 grams of this combined solution, and diluting with 996 grams of water. The scouring solution has a pH of 5.88–5.92. The bath containing the yarn is held at room temperature for 2 minutes, after which 300 ml of 0.1% Anthraquinone Blue B (C.I. Acid Blue 45) dye solution is added and the bath temperature is increased at a rate of 3° C./min to 95° C. and held at temperature for 90 minutes. The dyed samples are rinsed, dried, and measured for dye depth using a reflecting colorimeter.

Both MBB and ABB dye numbers are calculated from the reflectance values using the method described in Holfeld et al., U.S. Pat. No 4,030,880. The goal of the current invention is to control only the ABB dyeability without significantly affecting the MBB dyeability.

EXAMPLE

Nylon 6,6 base flake having an amine-end level of approximately 55 meq/kg, a relative viscosity (RV) of 45, a weight-average molecular weight (Mw) of 34,700, and a number-average molecular weight (Mn) of 16,600 was conditioned using methods well known in the art to obtain a base polymer flake having an amine-end level of approximately 40 meq/kg, RV of 60, Mw=40,400, and Mn=22,000. The conditioned base flake was fed into the throat of a 120 mm twin-screw extruder manufactured by Warner & Pfleiderer (Ramsey, N.J.) using a 2500 lb/hr capacity MD II Series 400 gravimetric feeder manufactured by Acrison, Inc. High amine-end nylon 6,6 flake having 97 meq/kg amine ends, a RV of 41, Mw=33,600, and Mn=17,100 was co-fed into the throat of the extruder using a 250 lb/hr capacity Model 101 gravimetric feeder manufactured by Acrison, Inc. The rate of addition of the high amine-end additive flake was 3% of the total throughput of the process and was controlled using a Honeywell DCS system using a control scheme linking feed rate of the additive feeder to total throughput. The total throughput for the system was 2000 lb/hr. The nylon flake was blended and melted in the extruder with the temperature increasing as the polymer progressed through the extruder from approximately 267° C. to approximately 289° C. The temperature was then maintained constant at approximately 290 ° C. as the polymer passed through the transfer line. The residence time of the polymer melt in line from the point of blending in the throat of the extruder to the point of extrusion at the spinneret was approximately 5.5 minutes. Laboratory experiments indicate that equilibration of nylon 6,6 polymers is less than about 5 minutes under similar conditions. The polymer was melt-spun at 290° C. into filaments using methods well-known to those skilled in the art. The resulting yarn had approximately 39 meq/kg amine ends, a RV of 65, Mw=42,800 and Mn=19900. The molecular weight curve was typical of a standard molecular weight distribution, with no evidence of a bimodal distribution indicating that the equilibration of the high-amine end and base flake was complete. The ABB dye number was 177 with a standard deviation of 10, and the MBB dye number was 180 with a standard deviation of 11. These numbers are averages of 60 readings taken over a period of 30 days. Approximately 50% of the standard deviation is due to the method error intrinsic in the ABB and MBB dye tests. Base flake without the additive flake would have yielded yarn having an amine-end group concentration of 37.5 meq/kg, the reduction in concentration from the conditioned polymer being due to the further polymerization which occurs in the extruder. The addition of 3 wt % of 99 meq/kg amine-end polymer therefore raised the amine-end group concentration by about 1.5 meq/kg and the ABB dyeability by about 20 dye units, as expected from theoretical calculations. There was no significant variation in MBB dyeability.

The additive feed rate should be maintained within about ±10% of the aim, e.g. 3%±0.3% for the example shown above. This is within the accuracy range of commercially available feeders.

I claim:

1. In a process for making melt-spun, dyeable polyamide fibers including the steps of feeding a first polyamide flake having a first amine-end level into an extruder, melting the flake and then extruding the molten polyamide into fibers, the improvement for modifying the dyeability of the fibers comprising the steps of:

a) co-feeding a second polyamide flake of the same polymer type but having a different amine-end level into the extruder with the first polyamide flake, the quantity and amine-end level of the second flake being such that when mixed with the first flake a mixture having a predetermined dyeability is obtained; and b) mixing and melting the two flakes under conditions of time and temperature which allow the molecular chain length and end-group concentrations of the molten polyamide mixture to approach equilibrium values through transamidation reactions before extruding the molten mixture into fibers.

2. In a process for making melt-spun, dyeable polyamide fibers including the steps of pumping a first polyamide through a transfer line to a spinneret, and then extruding the polyamide into fibers, the improvement for modifying the dyeability of the fibers comprising the steps of:

a) co-feeding a polyamide flake of the same polymer type but having a different amine-end level into the transfer line with the first polyamide, the quantity and amine-end level of the polyamide flake being such that when mixed with the first polyamide a mixture having a predetermined dyeability is obtained; and b) melting the polyamide flake and mixing the two polyamides under conditions of time and temperature which allow the molecular chain length and end-group concentrations of the molten polyamide mixture to approach equilibrium values through transmidation reactions before extruding the molten mixture into fibers.

3. The process of claim 1 where the polyamide is nylon 6,6.

4. The process of claim 2 where the polyamide is nylon 6,6.

* * * * *